US006102551A

United States Patent [19]

Hsu

[11] Patent Number: 6,102,551

[45] Date of Patent: Aug. 15, 2000

[54] CHRISTMAS LAMP ASSEMBLY

[75] Inventor: Wan-Hsing Hsu, Shatin, The Hong Kong Special Administrative Region of the People's Republic of China

[73] Assignee: Minah International Limited, Shatin, The Hong Kong Special Administrative Region of the People's Republic of China

[21] Appl. No.: 09/172,930

[22] Filed: Oct. 14, 1998

[30] Foreign Application Priority Data

Jul. 27, 1998 [CN] China ..... 98116737

[51] Int. Cl.[7] ..... H01R 33/00

[52] U.S. Cl. ..... 362/226; 362/439; 439/619; 439/699.2

[58] Field of Search ..... 362/226, 249, 362/439; 313/317; 439/280, 699.2, 242, 612, 619

[56] References Cited

U.S. PATENT DOCUMENTS

| | | | |
|---|---|---|---|
| 5,605,395 | 2/1997 | Peng | 362/226 |
| 5,735,597 | 4/1998 | Weng | 362/226 |
| 5,795,189 | 8/1998 | Liou | 439/699.2 |

*Primary Examiner*—Cassandra Spyrou
*Assistant Examiner*—Euncha Cherry
*Attorney, Agent, or Firm*—Haverstock & Owens LLP

[57] ABSTRACT

The present invention is related to a lamp assembly, and in particular, related to a Christmas lamp assembly comprising a lamp bulb and a lamp holder integrally molded of synthetic resin in a water-proof manner.

With the lamp bulb and the lamp holder according to the present invention, the former may be easily inserted into the latter for desirable electric connection, which may efficiently prevent raindrop or sludge from penetrating the inside of either of them and thus solve the problems of current leakage or short circuit in a conventional lamp assembly.

16 Claims, 6 Drawing Sheets

CHRISTMAS LAMP ASSEMBLY

BACKGROUND OF THE INVENTION

1. Field of the Invention

The present invention is related to a lamp assembly, and in particular, related to a Christmas lamp assembly comprising a plurality of lamp bulbs and a plurality of lamp holders integrally molded of synthetic resin in a water-proof manner.

2. Description of the Prior Art

It has been known from Taiwan Utility Model Patent No. 298295 as to an improvement of the Christmas lamp assembly, in which , as shown in FIGS. 1 through 3, the lamp assembly unit generally comprises a lamp bulb 1 having two metal wires 11 and 11 extending from the bottom thereof, a core 2 in the form of a hollow body opening to the top and having two through holes 21 and 21 at the bottom thereof through which the wires 11 and 11 may be inserted to the outside, a lamp holder 3 also in the form of a hollow body for receiving the core 2 at the upper portion thereof and being provided with an insertion hole 31, and two electric wires 4 and 4 having respectively two terminals 41 and 41 for being inserted through the insertion 31 to electrically connect the metal wires 11 and 11 of the lamp bulb 1, wherein the insertion hole 31 has cross sections 311 and 312 corresponding to the terminals 41 and 41 of the electric wires 4 and 4, the lamp holder 3 is provided with a flange 32 at the top thereof, an extension piece 22 extends downward from the bottom of the core 2 and has curved faces 221 and 222 respectively matching with the cross sections 311 and 312 thereby pinching two electric wires 4 and 4 upon engaging with the insertion hole 31 from above, and a peripheral groove 23 is arranged at the top of the core 2 so as to engage the flange 32 of the lamp holder 3 to prevent water from penetrating into the lamp holder 3 and ensure its engagement with the core 2.

In addition, there is disclosed another related improvement of lamp assembly in Taiwan Utility Model Patent No. 334102, in which, as shown in FIGS. 4 through 7, the lamp assembly comprises a core 2 having two protruded pieces 25 and 25 at the bottom thereof and a hollow portion 24 therein for engaging a lamp bulb 1 by inserting two wires 11 and 11 of the lamp bulb 1 through two bores 21 and 21 of the protruded pieces 25 and 25 and attaching them 11 and 11 to the outsides of the protruded pieces, a lamp holder 3 having two U-shaped engagement pieces 35 and 35 for engaging two protruded pieces 25 and 25 of the core 2, wherein two edges 36 and 36 disposed at the tops of the engagement pieces 35 and 35 and two hooks 37 and 37 disposed at the bottoms of the engagement pieces 35 and 35 may secure two terminals 41 and 41 of the electric wires 4 and 4 upon insertion of the wires 4 and 4 into the lamp holder from under, two convex pieces 38 and 38 being disposed at the lower portions of the engagement pieces 35 and 35, an insertion body 6 with a pair of curved grooves 61 and 61 respectively at both opposite sides corresponding to the positions of the convex pieces 38 and 38, wherein the curved grooves 61 and 61 may accommodate the electric wires 4 and 4 while engaging the insertion body 6 with the convex pieces 38 and 38, thereby reliably connecting the wires 4 and 4 in a water-proof way.

The inconvenience met in the above first-mentioned patent resides in that the electric wires 11 and 11 tend to deflect improperly and thus fail to electrically connect with the metal terminals 41 and 41, normally in the form of flat plates, since the wires 11 and 11 have to extend through the holes 21 and 21 of the core 2 and accurately fold left- or right-wise for desirable connection with the terminals 41 and 41, as shown in FIGS. 1 to 3. Accordingly, the lamp bulb 1 in question will not emit light. Further, the lamp holder 3 is generally made of opaque plastic, through which the above improper situation may not be watched until a real test is conducted. Thereafter, the failed connection must be replaced with a new one and, therefore, the yield as well as productivity thereof are considerably decreased.

Further, as shown in FIG. 3, the assembling sequence of the lamp assembly starts from the insertion of the bulb envelope 1 into the opening 24 of the core, which constitute a lamp bulb, and is succeeded by the insertion of the lamp bulb into the lamp holder 3. Since the bulb envelope is generally made of glass by blow molding, its outer profile may not appear constant in the circumference. As a result, there is always clearance existing between the bulb envelope 1 and the opening 24, through which water may easily penetrate into the lamp bulb from the outside, and thus causes problems of rusting corrosion or short circuit.

Moreover, the engagements between the lamp holder 3 and the electric wires 4 and between the extension piece 22 and the electric wires 4 and 4 may not be perfect to prevent water from penetrating into the clearance therebetween, and once more causes problems of rusting corrosion or short circuit.

In spite of the advantages claimed above, the inconvenience met in the above second-mentioned patent resides in that the bulb envelope 1, core 2, and lamp holder 3 arc separately made for later assembling together in a way similar to the first-mentioned patent. Especially, as shown in FIG. 7, the terminals 41 and 41 of the electric wires 4 and 4 are in the form of metal plates similarly thereto, the problems of bad electric connection, rusting corrosion and short circuit resulting from current leakage are also inevitable. Further, the insertion body 6 is additionally provided to prevent water from penetrating into the inside of the lamp holder 3, and thus increases the cost of parts and assembly.

The present invention is directed to solving the above drawbacks in the prior art. With the lamp bulb and the lamp holder according to the present invention, the former may be easily inserted into the latter for desirable electric connection with excellent water-proof ability, which may efficiently prevent water of raindrop or sludge from penetrating the inside of either of them and thus solve the problems of current leakage or short circuit in the above-mentioned prior arts.

SUMMARY OF THE INVENTION

To accomplish the above object , according to the first aspect of the present invention, there is provided a lamp assembly comprising a lamp bulb and a lamp holder for holding the lamp bulb, wherein the lamp bulb includes a pair of pins extending downward from the bottom of a cap of the lamp bulb; and two metal wires connecting a filament of an envelope of the lamp bulb at the upper portions thereof, the metal wires being embedded in the pins at the middle portions thereof and extending to the outside from the bottoms of pins at the lower portions thereof, and the lamp holder includes a hollow portion at the upper half thereof for accommodating the lamp bulb; and two metal sleeve terminals embedded in the lower half of the lamp holder for insertion of the pins to construct electric connection therebetween, each of the sleeve terminals being electrically connected with an external wire at the bottom end thereof, characterized in that the cap of the lamp bulb is integrally molded of synthetic resin so as to surround the bottom of the envelope in a water-proof manner, and that the lamp holder is integrally molded of synthetic resin with the sleeve terminals and the connection portions of the external wires embedded in the molded lamp holder in a water-proof manner.

According to another aspect of the present invention, each of the pins has a cross section of one selected from the group consisting of a circle, a rectangle and a polygon, and each of the sleeve terminals has a cross section matching with that of each of the pins.

According to a further aspect of the present invention, either of the sleeve terminals is connected with both of the external wires.

According to a further aspect of the present invention, a funnel-like guiding portion diverging upward is disposed at the upper portion of each of the sleeve terminals.

DETAILED DESCRIPTION OF THE EMBODIMENTS

Figure 1:
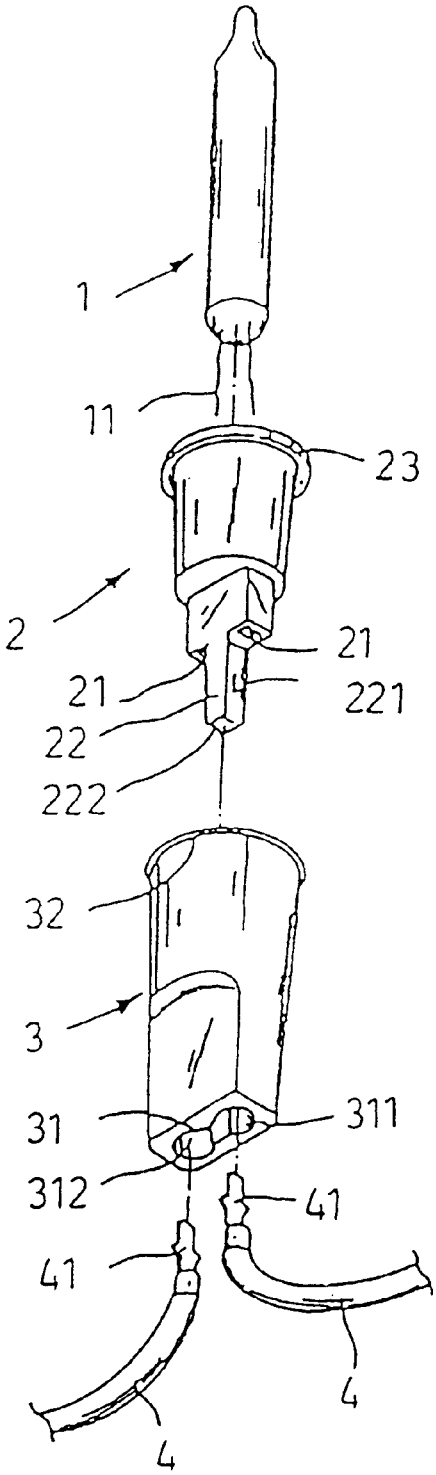
FIG. 1 (PRIOR ART)
FIG. 1 is an exploded perspective view of a unit of a conventional Christmas lamp assembly.
Figure 2:
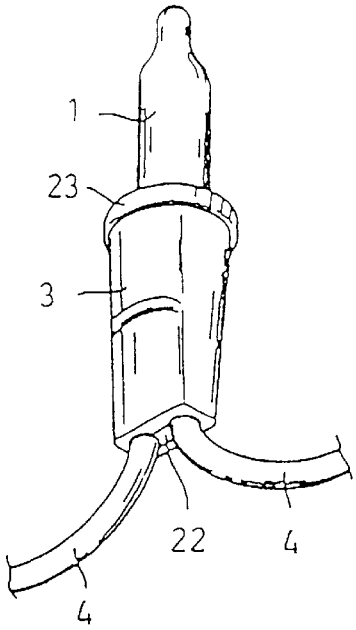
FIG. 2 (PRIOR ART)
FIG. 2 is a perspective view similar to FIG. 1, but showing the assembled status.
Figure 3:
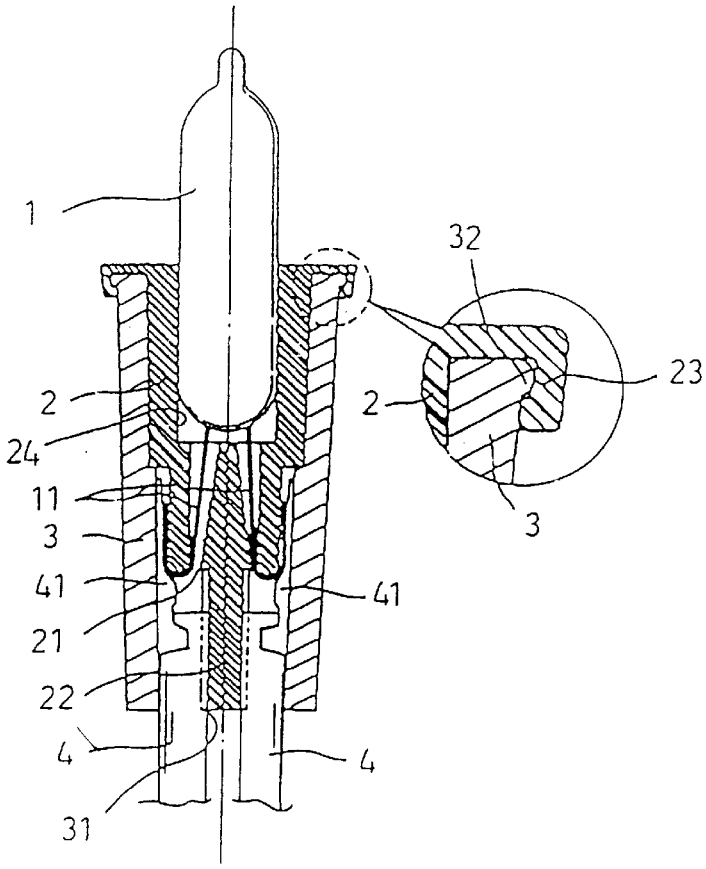
FIG. 3 (PRIOR ART)
FIG. 3 is a longitudinal sectional view of the unit in FIG. 1.
Figure 4:
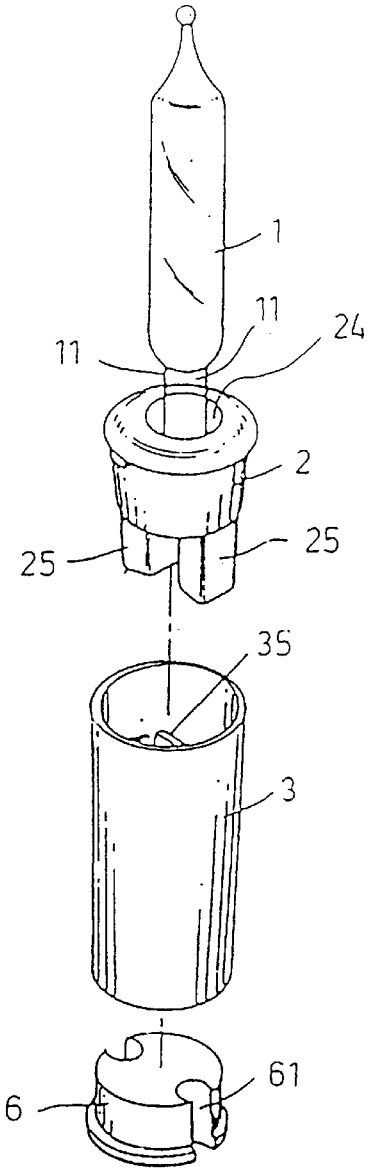
FIG. 4 (PRIOR ART)
FIG. 4 is a exploded perspective view of a unit of another conventional Christmas lamp assembly.
Figure 5:
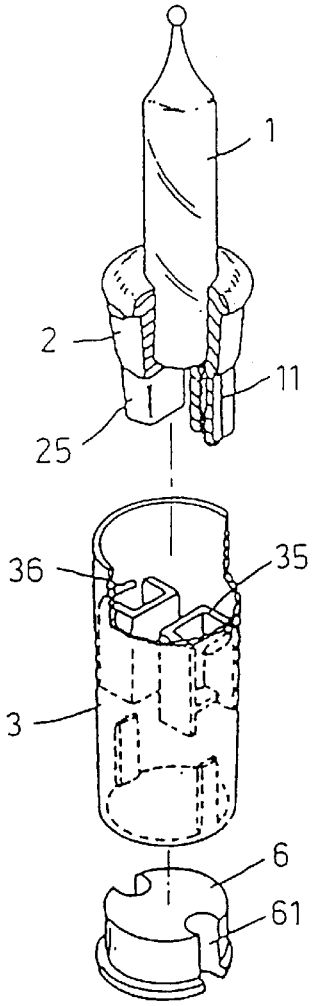
FIG. 5 (PRIOR ART)
FIG. 5 is a perspective view similar to FIG. 4, showing the internal structures of the lamp bulb and the lamp holder.
Figure 6:
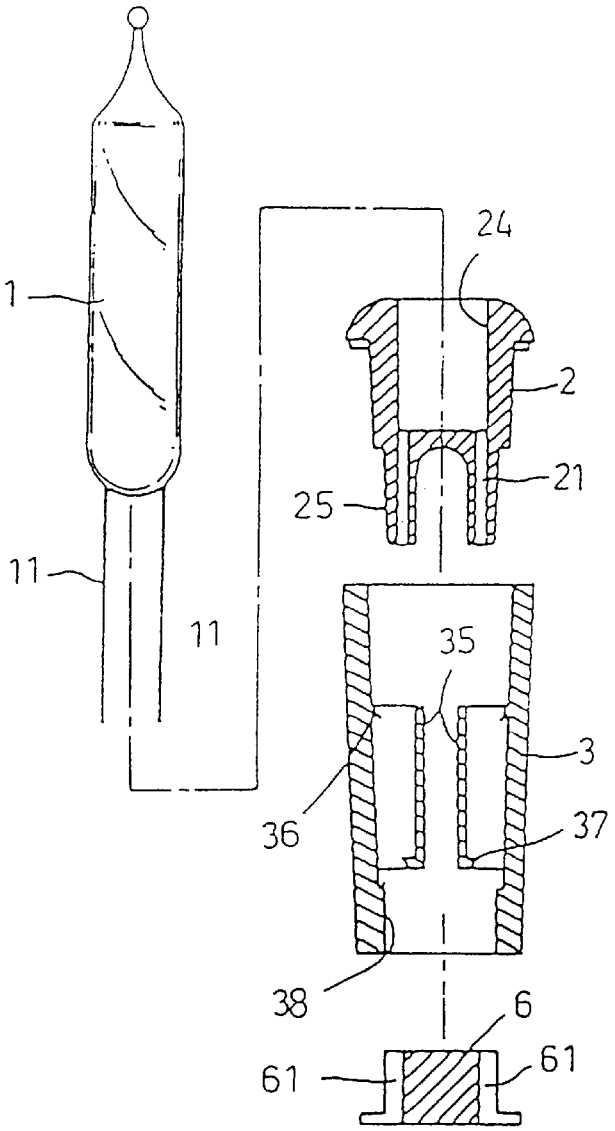
FIG. 6 (PRIOR ART)
FIG. 6 is a longitudinal sectional view of the unit of FIG. 4.
Figure 7:
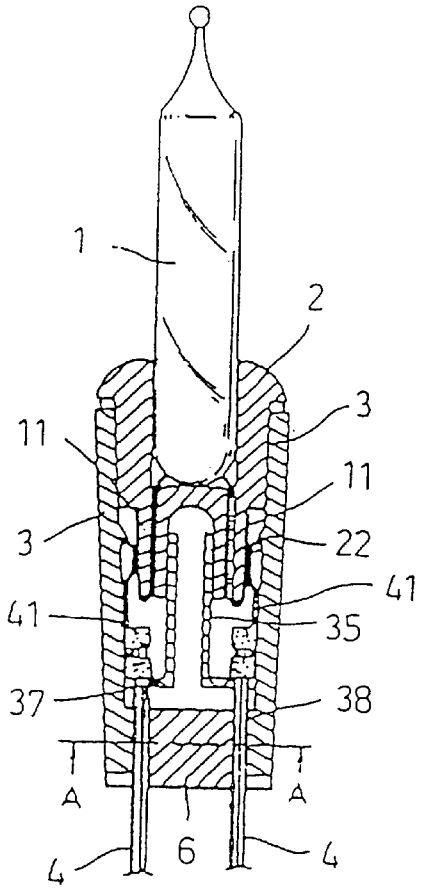
FIG. 7 (PRIOR ART)
FIG. 7 is a longitudinal sectional view of the unit of FIG. 4, showing the assembled status.
Figure 8:
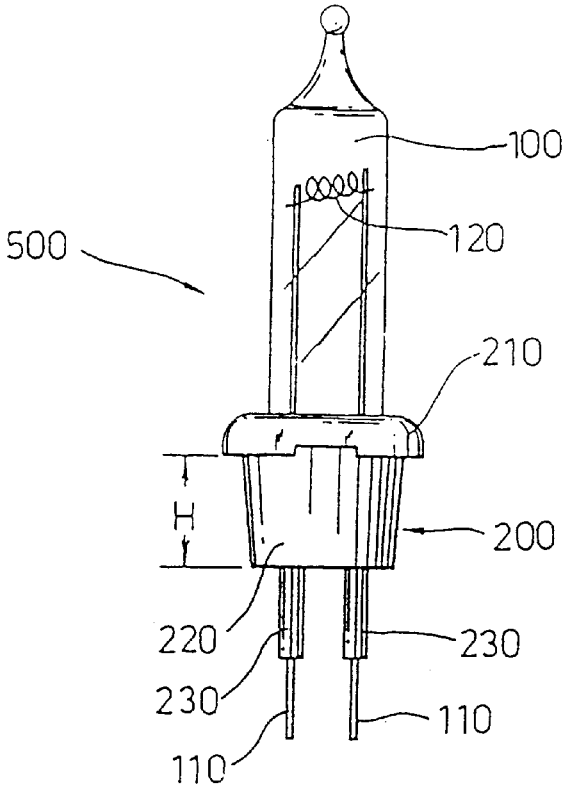
FIG. 8. is a plan view showing one embodiment of the lamp bulb according to the present invention.

One embodiment of a lamp bulb according to the present invention will be described below, with reference to FIG. 8 showing the side view thereof. In particular, the lamp bulb 500 consists of an envelope 100 and a lamp cap 200 assembled together with the envelope 100.

The slender and hollow envelope 100, made of glass through blow molding and degassed thereafter, has two separate metal wires 110 and 110 partially enveloped therein and extending to the outside from the bottom of the envelope 100. Generally, the metal wires are made of copper wires coated with magnesium. The ends, inside of the envelope 100, of the metal wires are respectively connected with both ends of a tungsten filament 120, which may emit light upon applying voltage across the metal wires 110 and 110.

The lamp cap 200 is integrally molded of synthetic resin so as to surround the bottom of the envelope 100.

The lamp cap 200 comprises an upper flange portion 210 and a cap body 220 in the form of a truncated cone, whose diameter is smaller than that of the flange portion 210 and decreased gradually from the joint therebetween. There are two cylindrical pins 230 and 230 extending downward from the bottom of the cap body 220. The metal wires 110 and 110 are embedded in the pins 230 and 230 with the lower portions thereof extending to the outsides of the pins 230 and 230.

In the present embodiment, the lamp cap 200 is integrally molded of synthetic resin so as to surround the bottom of the envelope 100 without any clearance existing therebetween. As a result, no water may be allowed to penetrate into the inside of the lamp bulb 100, and problems of corrosion or short circuit may be prevented.

One embodiment of a lamp holder according to the present invention will be described below with reference to FIG. 9. In this lamp holder 300 also integrally molded of synthetic resin, the leading portions of two wires 400 and 400 and the portions of two sleeve terminals connected with the wires are all embedded inside the molded lamp holder 300.

Figure 9:
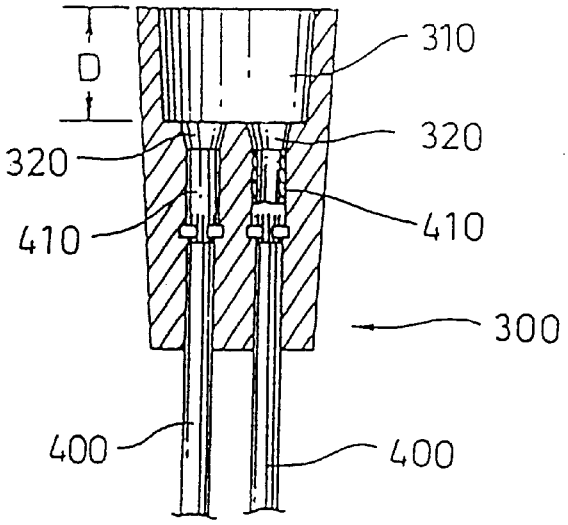
FIG. 9 is a longitudinal sectional view showing one embodiment of the lamp holder according to the present invention.

As shown in FIG. 9, the lamp holder 300 is generally in the form of a truncated cone converging downward, the upper half of which is arranged with a hollow portion 310 for precisely engaging the cap 200 of the lamp bulb 500. In particular, the depth D of the hollow portion 310 is equal to the height H of the cap body 200. As a result, the outer peripheral surface of the cap body 200 may precisely engage the inner peripheral surface of the hollow portion 310.

Upon molding the lamp holder 300, the leading portions of two electric wires 400 and 400 and two sleeve terminals 410 and 410 connected with the wires 400 and 400 are simultaneously embedded in the lamp holder 300. The molding process may be any known from the prior art, and its description is omitted.

The sleeve terminals 410 and 410 are provided to engage the cylindrical pins 230 and 230 extending from the cap body 200. Accordingly, the cross sections of the sleeve terminals 410 and 410 and the pins 230 and 230 are the same, while the inner diameter of the former is slightly larger than the outer diameter of the latter.

Further, in the present embodiment, two funnel-like guiding portions 320 and 320 diverging upward may be respectively arranged at the tops of the sleeve terminals 410 and 410 and embedded in the lamp holder 300 together therewith, so as to facilitate the insertion of the pins 230 and 230 into the sleeve terminals 410 and 410 with desirable electric connection.

According to the present embodiment, since the lamp holder 300 is integrally molded of synthetic resin with the terminals 410 and 410 and the connection portions of the wires 400 and 400 being completely embedded therein, no external water may be allowed to penetrate into the lamp holder 300.

Upon assembling the lamp bulb 500 and the lamp holder 300 together, the operator may simply insert the pins 230 and 230 of the cap 200 into the terminals 410 and 410 all the way until the outer peripheral surface of the cap body 220 completely engages the inner peripheral surface of the hollow portion 310 of the lamp holder 300.

Figure 10:
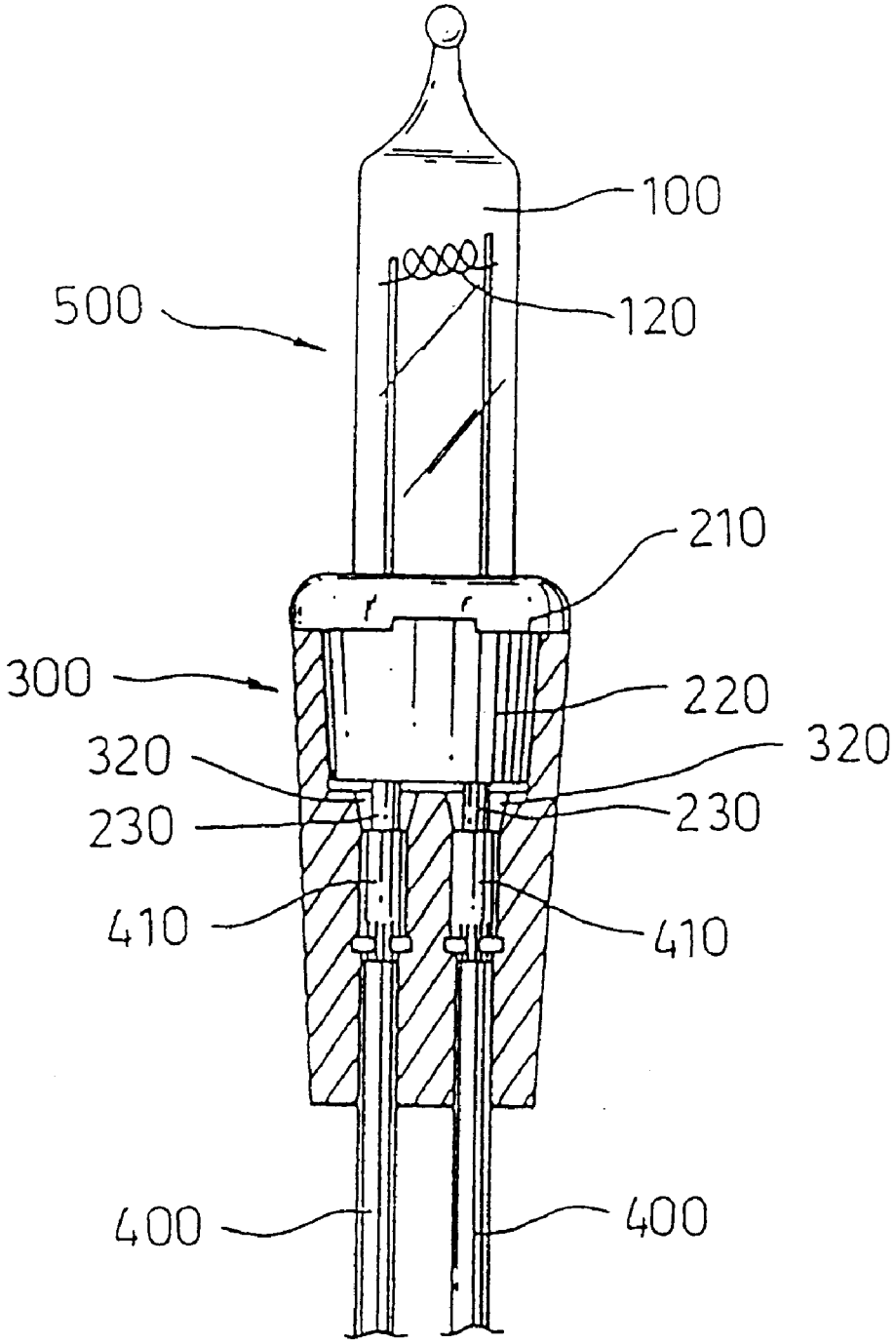
FIG. 10 is a view similar to FIGS. 8 and 9, showing the assembled status.

The assembled status of the lamp bulb and the lamp holder is shown in FIG. 10. As shown in FIG. 9, the wires 110 and 110 extend downward to the outsides of the pins 230 and 230. Upon inserting the pins 230 and 230 into the sleeve terminals 410 and 410, the exposed portions of wires 110 and 110 will be forced to fold upward by the bottom ends of the terminals 410 and 410 and become pinched between the outer peripheral surfaces of the pins 230 and 230 and the inner peripheral surfaces of the terminals 410 and 410, thus keeping good electric connection therebetween. Since the sleeve terminal 410 is in the form of a hollow cylinder, the electric connection therebetween will be excellent irrespective of the folding direction of the exposed portion of the wire 110. As a result, no problem of bad electric connection will occur.

In the above embodiment, the pins 230 and 230 of the lamp bulb 500 are designed to be in the form of a circular cylinder, and the sleeve terminals 410 and 410 for insertion thereto are designed correspondingly to be in the form of a hollow cylinder. The present invention is not limited to the above specific embodiment. That is, the above forms may be replaced with any one only requiring that the outer surface of the pin will completely engage the inner surface of the terminal. For example, the forms may be of a triangular, a square or a polygonal column and a corresponding hollow portion, respectively.

Further, as shown in FIGS. 8 to 10, each of the sleeve terminals 410 and 410 is connected with a single wire 400. However, in a variant of the above embodiment, either of the terminals 410 and 410 in the first or last of a series of lamp holders may be connected with two wires so as to serially connect the lamp holders to construct a complete Christmas lamp assembly.

The above embodiment is directed to a unit of a Christmas lamp assembly. In practice, the present invention may be applied to a series of lamp units. In addition, the present invention is not limited to the above specific embodiment and may be modified or amended by those skilled in the art in view of the principle of the present invention. Accordingly, the spirit and scope of the present invention are defined in the appending claims.

What is claimed is:

1. A lamp assembly comprising a lamp bulb and a lamp holder for holding the lamp bulb, wherein the lamp bulb includes a cap having a bottom, a pair of pins extending downward from the bottom of the cap two metal wires each having an upper portion, a middle portion and a lower portion, the upper portions coupled to a filament of an envelope of the lamp bulb, wherein each of the middle portions of the metal wires are embedded in a respective one of the pair of pins and the lower portions of the wires extend to an outside of the lamp bulb from the pins, and the lamp holder includes a hollow portion for accommodating the lamp bulb; and two metal sleeve terminals embedded in the lamp holder for receiving the pins and forming an electric connection between the pins and the metal sleeve terminals, wherein each of the sleeve terminals is electrically connected with an external wire, wherein the cap of the lamp bulb is integrally molded of synthetic resin so as to surround the envelope in a water-proof manner, and the lamp holder is integrally molded of synthetic resin with the sleeve terminals and the external wires embedded in the lamp holder in a water-proof manner.

2. A lamp assembly according to claim 1, wherein each of the pins has a cross section of one selected from the group consisting of a circle, a rectangle and a polygon, and each of the sleeve terminals has a cross section matching with that of each of the pins.

3. A lamp assembly according to claim 1, wherein either of the sleeve terminals is connected with both of the external wires.

4. The lamp assembly accordingly to claim 1, wherein the sleeve terminals include a guiding portion.

5. A lamp assembly comprising:

a. a lamp bulb having a hollow lamp envelope containing a filament and a first metal wire and a second metal wire, wherein each of the first and second metal wires are coupled to the filament;

b. a lamp cap integrally molded of synthetic resin coupled to the hollow lamp envelope having a first pin and a second pin, wherein the first and second metal wires extend from the hollow lamp envelope and through the first and second pins;

c. a lamp housing coupled to the lamp cap and including integrally formed first and second metal sleeve terminals, wherein the first metal sleeve terminal is coupled at a first end to a first electrical wire embedded in the lamp housing and configured for receiving the first pin at a second end thereby establishing a first electrical connection between the first electrical wire and the first metal wire in the first pin, and further wherein the second metal sleeve is coupled at a third end to a second electrical wire embedded in the lamp housing and configured for receiving the second pin at a fourth end thereby establishing a second electrical connection between the second electrical wire and the second metal wire in the second pin.

6. The lamp assembly according to claim 5, wherein each of the first and second pins has a cross section having a shape of one selected from the group consisting of a circle, a rectangle and a polygon.

7. The lamp assembly according to claim 6, wherein each of the first and second sleeve terminals has a cross section having a shape matching with that of the first and second pins respectively.

8. The lamp assembly according to claim 5, wherein the first and second electrical wires are both coupled to a selected one of the first and second metal sleeves.

9. The lamp assembly accordingly to claim 5, further comprising a guiding portion disposed at the second end of the first sleeve terminal and the fourth end of the second sleeve terminal for guiding the first and second pins into the first and second sleeve terminals respectively.

10. A Christmas light assembly comprising a plurality of lamp assemblies which are serially coupled, wherein each lamp assembly includes:

a. a lamp bulb having a hollow lamp envelope containing a first metal wire and a second metal wire which are each coupled to a filament;

b. a lamp cap integrally molded of synthetic resin coupled to the hollow lamp envelope having a first pin and a second pin, wherein the first and second metal wires extend from the hollow lamp envelope and through the first and second pins; and c. a lamp housing coupled to the lamp cap and including integrally formed first and second metal sleeve terminals, wherein the first metal sleeve terminal is coupled at a first end to a first electrical wire embedded in the lamp housing and configured for receiving the first pin at a second end thereby establishing a first electrical connection between the first electrical wire and the first metal wire in the first pin, and further wherein the second metal sleeve is coupled at a third end to a second electrical wire embedded in the lamp housing and configured for receiving the second pin at a fourth end thereby establishing a second electrical connection between the second electrical wire and the second metal wire in the second pin.

11. The Christmas light assembly according to claim 10, wherein the first and second pins of each lamp assembly each have a cross section having a shape selected from the group consisting of a circle, a rectangle and a polygon.

12. The Christmas light assembly according to claim 11, wherein the first and second sleeve terminals of each lamp assembly each have a cross section having a shape matching the shape of the first and second pins respectively.

13. The Christmas light assembly according to claim 10, wherein the first and second electrical wires are both coupled to either of the first or second metal sleeves.

14. The Christmas light assembly accordingly to claim 10, wherein each of the lamp assemblies further include guiding portions disposed at the second end and the fourth end of each of the first and second sleeve terminals for guiding the first and second pins into the first and second sleeve terminals respectively.

15. A method of constructing a light assembly, comprising the steps of:

a. forming a lamp bulb of glass, wherein the lamp bulb is in the shape of a hollow envelope having a closed end and an open end and containing a filament and first and second metal wires coupled to the filament;

b. molding a lamp cap from synthetic resin around the open end of the lamp bulb, wherein the lamp cap has a bottom surface from which a first pin and a second pin each extend and further wherein the first and second metal wires extend through the first and second pins respectively;

c. forming a lamp housing from synthetic resin having a hollow opening on a first side which contains a first metal sleeve terminal with a first embedded electrical wire and a second metal sleeve terminal with a second embedded electrical wire;

d. coupling the lamp housing to the lamp cap such that the first metal sleeve terminal accepts the first pin, thereby electrically coupling the first metal wire to the first embedded electrical wire, and the second metal sleeve terminal accepts the second pin, thereby electrically coupling the second metal wire to the second embedded electrical wire.

16. The method of constructing a light assembly as in claim 15, wherein the lamp bulb is formed from glass through the process of blow molding.

* * * * *

UNITED STATES PATENT AND TRADEMARK OFFICE

CERTIFICATE OF CORRECTION

PATENT NO. : 6,102,551

DATED : August 15, 2000

INVENTOR(S) : Wan-Hsing Hsu

It is certified that error appears in the above-identified patent and that said Letters Patent is hereby correct as shown below:

In column 2, line 29, delete "arc" and insert --are--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*